United States Patent [19]

Faulk

[11] 3,955,313

[45] May 11, 1976

[54] COMBINATION GAME CALL

[76] Inventor: Paul Dudley Faulk, 616 18th St., Lake Charles, La. 70601

[22] Filed: Dec. 16, 1974

[21] Appl. No.: 533,165

[52] U.S. Cl. ..... 46/178; 46/180

[51] Int. Cl.[2] ..... A63H 5/00

[58] Field of Search ..... 46/177, 178, 180

[56] References Cited

UNITED STATES PATENTS

| | | | |
|---|---|---|---|
| 387,338 | 8/1888 | Canney | 46/178 |
| 751,153 | 2/1904 | Einstein | 46/180 |
| 3,029,554 | 4/1962 | Mobley | 46/180 |

*Primary Examiner*—Louis G. Mancene
*Assistant Examiner*—Robert F. Cutting
*Attorney, Agent, or Firm*—Cushman, Darby & Cushman

[57] ABSTRACT

A combination animal or fowl call device is disclosed, wherein a pair of conventional call barrels, each with associated trough elements and reeds, are mounted in either end of a common throat element. The throat element has a plurality of apertures connecting the inner sound chamber thereof with the atmosphere. Suitably, one throat element and associated reed produces the sound of a duck, whereas the other throat element and associated reed produces the sound of a goose. As the pitch of the call may be changed by closing one or more apertures (as long as at least one aperture is left open), a single call can produce the sounds of, e.g. both a Black Duck and a Mallard and a Snow-and-Blue Goose and a Canadian Goose.

Thus, it is possible using the call device of the present invention to produce the sounds of numerous animals or fowl from a single such device.

11 Claims, 4 Drawing Figures

COMBINATION GAME CALL

BACKGROUND OF THE INVENTION

The present invention relates to a combination call device, capable of reproducing the sounds of a plurality of animals or fowl. In particular, the present invention is directed to a combination duck and goose call, wherein instant pitch modification of the call is possible.

The Wootten U.S. Pat. No. 582,890 relates to a Campaign Horn which can receive a blast of air from either end. The device has an intermediate side opening, with a swinging device pivotally mounted in the opening, to be swung outward by the air blast.

The Canney U.S. Pat. No. 387,338 relates to a Wind Instrument which comprises a cylinder having a solid partition mounted therein. On opposite sides of the partition are mounted movable pistons to which are secured the ends of reed pipes or horns containing vibrotory reeds. During operation, the cylinder is moved relative to the horns, causing air to be intermittently admitted through each horn and passed out through the reed openings.

The Eisenstein U.S. Pat. No. 751,153 relates to a Musical Cane having a double reed mounted in one end of the cane, and opening to a hollowed section of the cane. The hollowed section of the cane is connected to the atmosphere by a series of apertures. Sounds may be produced by blowing through a mouthpiece or through the various apertures.

The Reynolds U.S. Pat. No. 827,819 relates to a duck call having a double reed, which can be blown from either end.

The Fahey U.S. Pat. No. 2,551,367 relates to a Plural Tone Duck Call which contains two separate reeds, which can be operated separately or at the same time, depending upon the selection of air passages through a rotatable cap.

The Testo U.S. Pat. No. 3,054,216 relates to a combination Call Device, wherein a plurality of calls, each with its own associated mouthpiece sounding trough reed and throat element, are mounted in abutting or side-by-side relationship.

Pritchard et al U.S. Pat. No. 3,466,794 relates to a fowl caller which has a plurality of passages holding reed-equipped, sound-emitting callers. A rotary mouthpiece is used to select a given passage.

SUMMARY OF THE INVENTION

The present invention resides in the provision of a combination animal or fowl call device having a single, central sound chamber, with mouthpieces and air-responsive sounding devices located in each end of the sound chamber. A plurality of apertures are located in the wall of the sound chamber, connecting the interior of the sound chamber with the atmosphere.

The user may blow air through either mouthpiece to actuate the sounding device contained therein. The air passing through the sounding device passes to the central sound chamber, from whence it is discharged to the atmosphere through one or more of the apertures. At least one aperture is maintained in the open condition, but one or more of the remaining apertures may be closed to produce desired changes in pitch of the call.

DETAILED DESCRIPTION OF THE INVENTION

The invention will be more clearly understood with reference to the accompanying drawings, wherein FIG. 1 is an elevational view of the combination call device of the present invention;

Figure 1:
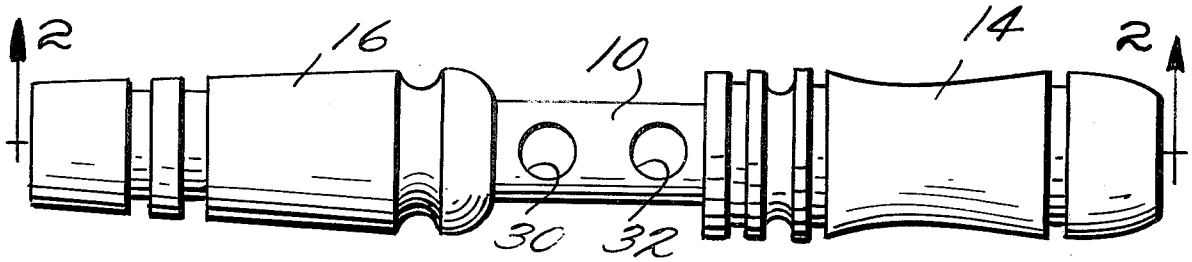
Figure 2:
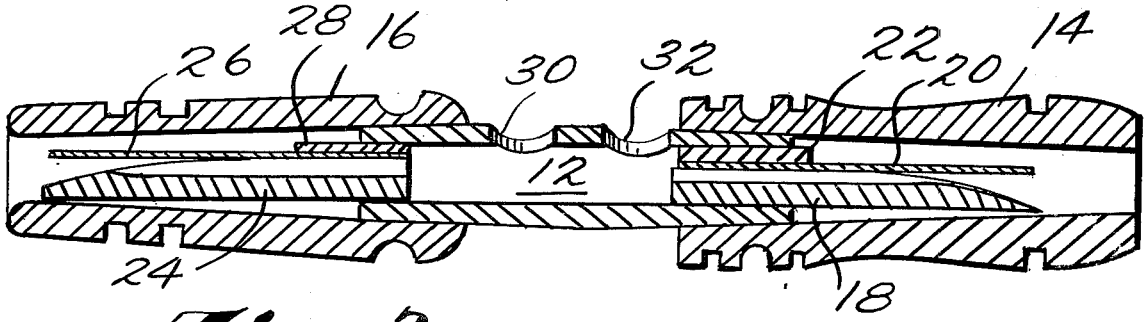
FIG. 2 is a cross-sectional view of the call device of FIG. 1, taken along line 2 — 2.

In FIGS. 1 and 2, housing 10 defines central sound chamber 12. Goose-call mouthpiece 14 is located on one end of housing 10, and duck-call mouthpiece 16 is located on the other end. Goose-call mouthpiece 14 has an associated trough element 18, reed 20, and wedge 22, mounted in one end of housing 10 and surrounded by mouthpiece 14. Mounted in the other end of housing 10 are trough element 24, reed 26, and wedge 28, which produce the sound of a duck. These elements are surrounded by barrel 16. Mouthpieces 14, 16 are generally frustoconically flared on their inner ends to removably receive and frictionally retain sound chamber 10. Sound chamber 10 itself is generally frustoconically flared on each end of sound chamber 12 to removably receive and frictionally retain the assembly of trough elements 18 or 24, reeds 20 or 26, and wedges 22 or 28, respectively.

Apertures 30, 32 are located in the walls of housing 10 and connect sound chamber 12 to the atmosphere.

It is greatly preferred for ease of construction to have housing 10 and mouthpieces 14, 16 tubular in nature, but it will be readily appreciated that other configurations, while decidedly less preferred, may be used if desired.

The trough elements, reeds, wedges, and mouthpieces are conventional, and any of the normal designs may be used if desired. For instance, the design described in my U.S. Pat. No. 3,406,479 may be used if desired. The disclosure of this patent is hereby incorporated by reference.

From consideration of FIG. 2, it will be appreciated that when blowing on one end of the call device, minor amounts of air may escape out the other end of the device, through the opposite trough and barrel. However, most of the air blown into the device will pass out of one or both apertures 30, 32.

In addition to the selection of conventional troughs and reeds, other variables in the call device of the present invention include the size of the central sound chamber, the aperture size, the aperture location, and spacing of the apertures from each other, the shape of the aperture, the use of more than two apertures, and the like.

Within these variables, the proper selection of design parameters can be readily chosen by those in the art to produce the desired sounds. As an illustration of a suitable call, a housing 10 having an internal diameter of ½ inch and a space of about 2 inches between the inner ends of wedges 22, 28 is quite suitable. Two round apertures each having a diameter of ⅜ inch and spaced 9/8 of an inch apart (center-to-center), can conveniently be used.

Figure 3:
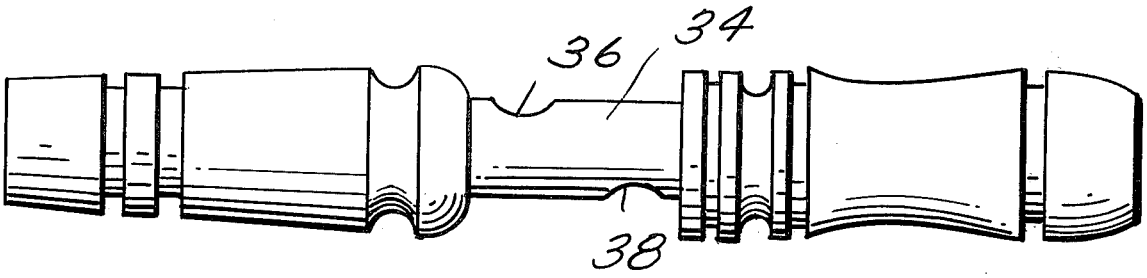
FIG. 3 is a different embodiment of the combination call device of FIG. 1.

The apertures may be located on opposite sides of the housing, as illustrated in FIG. 3, wherein housing 34 contains apertures 36, 38.

Figure 4:
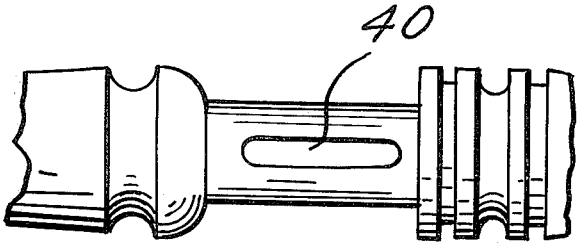
FIG. 4 illustrates a different embodiment of the design of an aperture.

For ease of fabrication, round apertures are preferred. However, aperture 38 in housing 34 may be replaced by an elongated slot 40, as illustrated in FIG. 4 (with a corresponding change, if desired, to aperture 36) or other configurations of the aperture may be readily used.

While the combination call device of the present invention has been described hereinabove as a combination duck-goose call, it will be readily appreciated that other combinations of fowl or animal calls may be used as desired. For instance, one end of the call could be a speckled-belly goose call, whereas the other end of the call could be a conventional snow or blue goose call. Alternatively, one end of the call could produce a conventional mallard duck sound, whereas the other end of the call could be a pintail duck whistle. Conventional mallard calls could be used on either end of the call device, with different tone/pitch so that a considerable lattitude of tone and pitch could be achieved, especially when using the apertures. Furthermore, one end of the call could be a high-pitched predator call, and the other end could be a deep-tone predator call. Other combinations will be readily apparent to those working in the art.

While it is preferred that the various components of the call device be frictionally retained together, it will be appreciated that components may be adhered together or otherwise joined, e.g., by solvent welding plastic parts. The reed may be of any conventional material, such as of plastic (including nylon, polyethylene, polypropylene, polyvinylchloride and copolymers thereof, etc.) or metal. The mouthpieces, the sound chamber, and the trough elements are preferably of wood, but plastic or other materials could be used.

Generally the apertures will have a size equivalent to the area of a circular hole ⅛ inch to ¾ inch in diameter. It is preferred that the aperture have a size corresponding to the area of a circular hole ⅜ inches in diameter. However, as mentioned hereinabove, the size of the aperture may be varied over a wide range, depending upon the desired type of call and pitch and tone thereof. Furthermore, the aperture size may depend to some degree upon other variables in the call construction.

It is preferred that the apertures be a simple opening through the wall of the central housing, connecting the central sound chamber to the atmosphere. This permits the user to utilize his fingers to block one or more apertures, during operation of the call device. However, it will be appreciated that it is possible to utilize removable plugs to block one or more of the apertures, or a sleeve which is slidable along the length of the central housing could be used to selectively block an aperture, or even a portion thereof, in order to produce the desired sounds.

I claim:

1. A combination animal or fowl call device comprising wall means having two ends and defining a central sound chamber, mouthpiece means located at each end of said wall means and including a passageway connected to said chamber, air-responsive sounding means in each passageway, and a plurality of aperture means located in said wall means for controlling the passage of air through said cell device to produce the desired animal or fowl sound.

2. Call device of claim 1, wherein said aperture means are circular holes.

3. Call device of claim 2, wherein said air-responsive sounding means include a trough with a channel thereon, and a reed overlying said channel.

4. Call device of claim 3, wherein the sounding means in one passageway simulates the sound of a duck, and the sounding means in the other passageway simulates the sound of a goose.

5. Call device of claim 4, wherein two aperture means are located in said wall means.

6. Call device of claim 2, wherein said holes have a diameter of about ⅜ inch.

7. A combination duck and goose call comprising a central sound chamber defined by a tubular throat element, a channeled trough element mounted in each end of the tubular throat element, a reed mounted in duck sound-producing relationship to the channel of one throat element, a reed mounted in goose sound-producing relationship to the channel of the other throat element, a barrel surrounding each said through element and associated reed, and a plurality of apertures in said throat element connecting the said chamber with the atmosphere.

8. Call of claim 7, wherein said throat element has two apertures.

9. Call of claim 8, wherein said aperture means are circular holes.

10. Call of claim 9, wherein said holes have a diameter of about ⅜ inch.

11. Call of claim 8, wherein the apertures are generally on the same side of the throat element.

* * * * *